United States Patent [19]

Larkin

[11] Patent Number: 4,601,704

[45] Date of Patent: Jul. 22, 1986

[54] CONTAINER MIXING SYSTEM WITH EXTERNALLY MOUNTED DRUG CONTAINER

[75] Inventor: Mark E. Larkin, Lindenhurst, Ill.

[73] Assignee: Abbott Laboratories, North Chicago, Ill.

[21] Appl. No.: 546,139

[22] Filed: Oct. 27, 1983

[51] Int. Cl.[4] ..... A61J 1/00

[52] U.S. Cl. ..... 604/87; 604/88; 604/416

[58] Field of Search ..... 604/56, 82, 87–88, 604/92, 408, 411, 414, 415, 416; 206/222

[56] References Cited

U.S. PATENT DOCUMENTS

| | | | |
|---|---|---|---|
| 2,590,900 | 4/1952 | Sommerstein . | |
| 2,721,552 | 10/1955 | Nosik | 604/88 |
| 2,778,360 | 1/1957 | Miskel . | |
| 3,306,563 | 2/1967 | Soto | 604/88 |
| 3,636,950 | 1/1972 | Gomez . | |
| 3,840,136 | 10/1974 | Lanfranconi et al. | 206/222 |
| 3,875,012 | 4/1975 | Dorn et al. . | |
| 3,915,212 | 10/1975 | Bujan et al. | 604/415 |
| 3,968,872 | 7/1976 | Cavazza | 206/222 |
| 4,048,999 | 9/1977 | Kobel . | |
| 4,059,112 | 11/1977 | Tischlinger . | |
| 4,089,432 | 5/1978 | Crankshaw et al. . | |
| 4,161,178 | 7/1979 | Genese . | |
| 4,172,457 | 10/1979 | Choksi et al. . | |
| 4,187,893 | 2/1980 | Bujan | 604/408 |
| 4,289,648 | 9/1981 | Hoskins et al. . | |
| 4,294,351 | 10/1981 | Cheetham | 206/222 |
| 4,306,554 | 12/1981 | Schwartz et al. . | |
| 4,392,850 | 7/1983 | Elias et al. | 604/82 |
| 4,405,317 | 9/1983 | Case . | |
| 4,412,836 | 11/1983 | Brignola . | |
| 4,417,890 | 11/1983 | Dennehey et al. . | |
| 4,467,588 | 8/1984 | Carveth . | |
| 4,515,586 | 5/1985 | Mendenhall et al. | 604/87 |

*Primary Examiner*—C. Fred Rosenbaum
*Assistant Examiner*—Michelle N. Lester
*Attorney, Agent, or Firm*—Robert W. Stevenson; Martin L. Katz

[57] ABSTRACT

A container mixing system wherein a medicament is placed in a container mounted externally of a container with a diluent. Mixing of the medicament in one container with the diluent in the other is accomplished by moving a piston member with a piercing element in the direction of the diluent container to pierce a diaphragm or stopper in the medicament container. In one embodiment, the medicament container is sealed by means of a flange to the diluent container wall and the piercing element will pierce a diaphragm and the container wall with the piercing member also serving as an injection site.

4 Claims, 9 Drawing Figures

CONTAINER MIXING SYSTEM WITH EXTERNALLY MOUNTED DRUG CONTAINER

BACKGROUND OF THE INVENTION

This invention relates to a container mixing system having manual means to intermix the contents of two containers, one of which is secured outside the other. More particularly, this invention relates to an additive transfer container for a medicament which is made a part of a flexible, diluent container and includes a piercing spike which will effect communication between the two containers upon actuation. In this manner the contents of the two containers can be intermixed and the resulting solution administered intravenously to a patient.

Devices providing separate compartments in a container for separately enclosing different components in such a way that they may be later intermixed in a single container are described in U.S. Pat. No. 2,176,923 to Nitardy, U.S. Pat. No. 3,290,017 to Davies, et al. and U.S. Pat. No. 3,532,254 to Burke, et al. These devices are deficient in not being able to maintain an effective seal between the two components to be intermixed. Additionally in some instances, a barrier between separate chambers does not adequately withstand the rigors of handling and shipping leading to premature removal. For containers used in health care situations, sterility must be maintained. While many of the prior art devices are simple in configuration the arrangement of parts makes them difficult to sterilize unless the entire device is assembled in a totally sterile environment. Such manufacture is exceedingly expensive.

It is an advantage of the present invention to afford a manually operated container mixing system not subject to the aforementioned disadvantages of the prior art such as those relating to sterility and premature activation. Other advantages are: a manually operable dual container system wherein fluid communication between the containers is effected by means of a slidable piercing spike passing through the wall of a flexible container; an activating spike and piston member for a two container mixing system which also affords an additive port; a two container mixing system wherein the container with a medicament can be secured to a flexible container in a sterile manner utilizing standard sealing techniques. Still other advantages of the present invention will become apparent as the description proceeds.

SUMMARY OF THE INVENTION

The foregoing advantages are accomplished and the shortcomings of the prior art are overcome by the present container mixing system wherein two containers are secured together and provide separate sterile compartments for different fluid materials. A piercable sealing means separates the first and second container. A second container for a second fluid material is secured to the first container. A combined piston and piercing member is disposed in the second container which upon activation will cause a piercing of the sealing means and delivery of the contents of the second container into the first. In a preferred manner, a diaphragm is placed between the two containers, one of which is a flexible plastic container for intravenous solutions. In one embodiment the piston member has a force directing projection which, like the piercing pin, is hollow to provide an injection site.

DESCRIPTION OF THE DRAWINGS

A better understanding of the two container mixing system of this invention will be had by reference to the drawings wherein.

DESCRIPTION OF THE EMBODIMENTS

Figure 1:
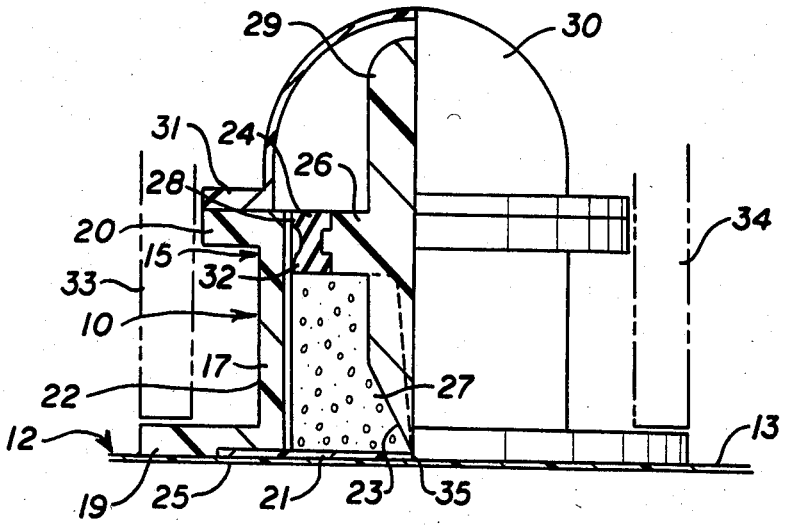
FIG. 1 is a view in side elevation with a portion in vertical section of one of the containers illustrating the piston and piercing components.
Figure 2:
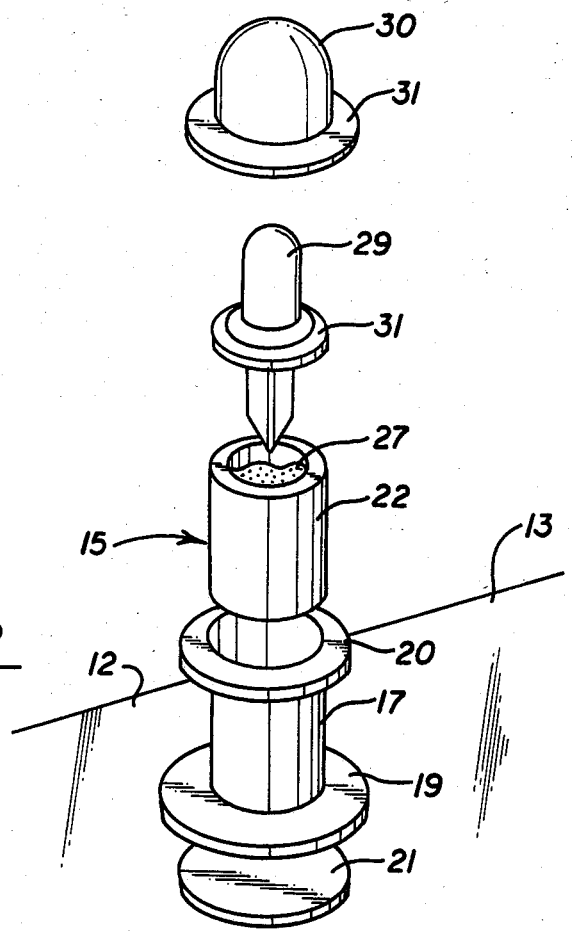
FIG. 2 is an assembly view of the container shown in FIG. 1 as well as a container wall to which it is secured.

Referring to FIGS. 1 and 2 of the drawings, a mixing container generally 10 is disclosed in conjunction with a first container indicated generally at 12 which will be a typical flexible plastic bag suitable for sterile I.V. solutions. The wall of this container is indicated at 13. Secured to wall 13 is a second container 15 which includes an outer cylindrical wall 17 having a flange 19 for sealable engagement with wall 13. At the opposing end is another flange 20 for sealable engagement with flange 31 of flexible cap 30. Positioned inside outer cylindrical wall 17 is inner tubular member 22 as well as a pierceable diaphragm 21 disposed transversely thereto with a portion extending under flange 19, as indicated by cutaway portion 25. In sealable engagement with inner tubular member 22 is piston member 24 having ringed sections 28 and 32. A connecting portion 26 engages piston member 24 and has a piercing pin 23 with point 35 extending therefrom. Extending in the opposite direction is a projecting portion 29 which is housed in cap 30.

Figure 3:
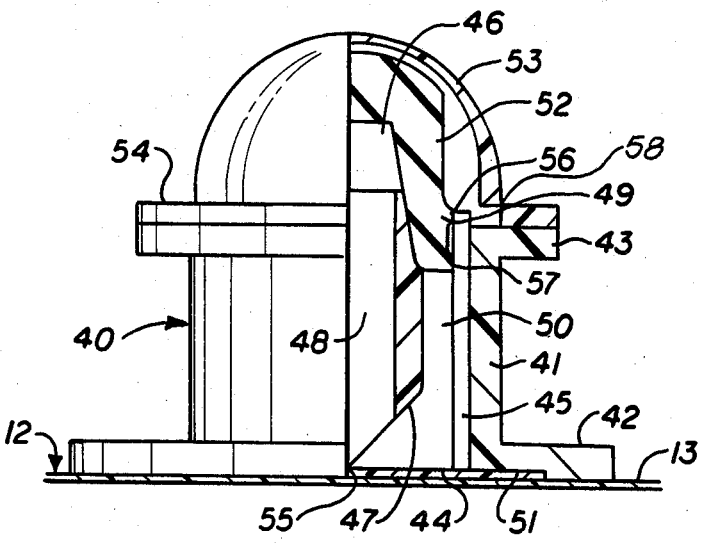
FIG. 3 is a view similar to FIG. 1 illustrating an alternative embodiment.

In FIG. 3, an alternative embodiment 40 of the second container is disclosed wherein similar to embodiment 15, an outer cylindrical wall 41 is sealed to first container wall 13 by means of flange 42. Flange 43 provides a seal for flange 54 of flexible and frangible cap 53. It will be seen that cap 53, if required, can be removed from flange 43 and flange 54 due to weakened portion 58. An inner tubular member 45 is positioned inside outer cylindrical wall 41 and pierceable diaphragm 44 extends transversely thereto and is accommodated in cutaway portion 51 of flange 42. A projecting portion 52 has a piston section 49 in sealing engagement with inner tubular member 45. Two rings 56 and 57 provide this sealing arrangement. A piercing pin member 47 extends from projecting portion 52 and includes a piercing point 55. It will be noted in conjunction with this embodiment that both the projecting portion 52 and the piercing pin member 47 have hollow or passage portions 46 and 48, respectively.

Figure 4:
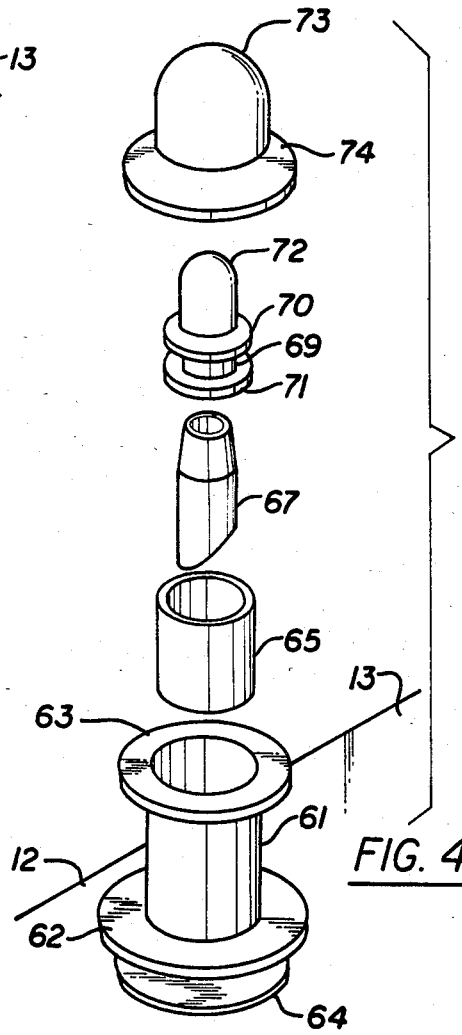
FIG. 4 is a view similar to FIG. 2 showing the embodiment of FIG. 3.
Figure 5:
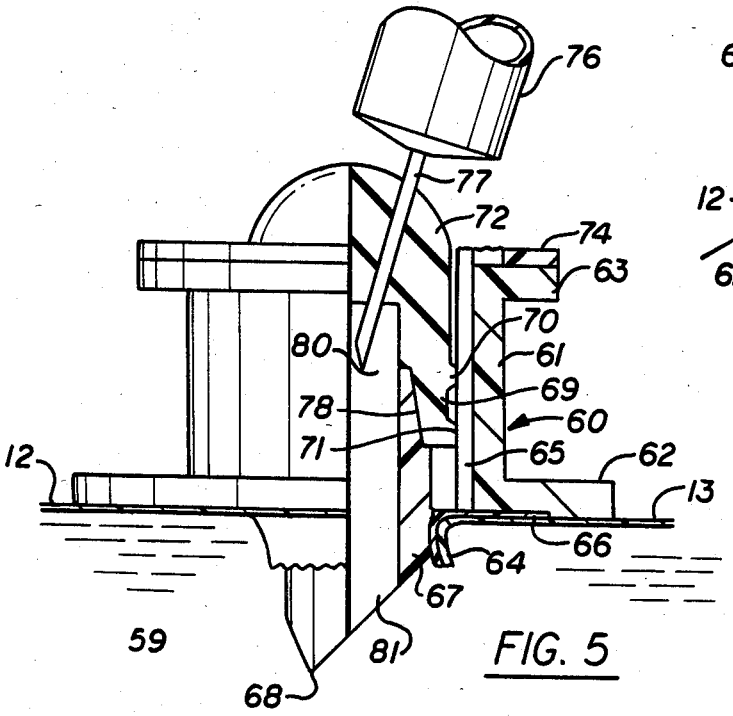
FIG. 5 is a view similar to FIG. 1 illustrating the activation of the two container system as well as its use as a secondary injection site.

Referring to a second container generally 60 in FIGS. 4 and 5, it will be noted that projecting portion 72 and piercing pin 67 also have respective hollow passages 80 and 81. It, like the previous embodiments, has an inner tubular member 65 for sealable contact with rings 70 and 71 and a diaphragm 64 extending under flange 62 and in contact with container wall 13. Cutaway section 66 affords suitable sealing with flange 62. Piercing pin 67 also has a piercing point 68 and is secured to projection 72 at offset section 78. In this instance, flange 74 of cap 73 is secured to flange 63 in a frangible manner as indicated in FIG. 5.

Figure 6:
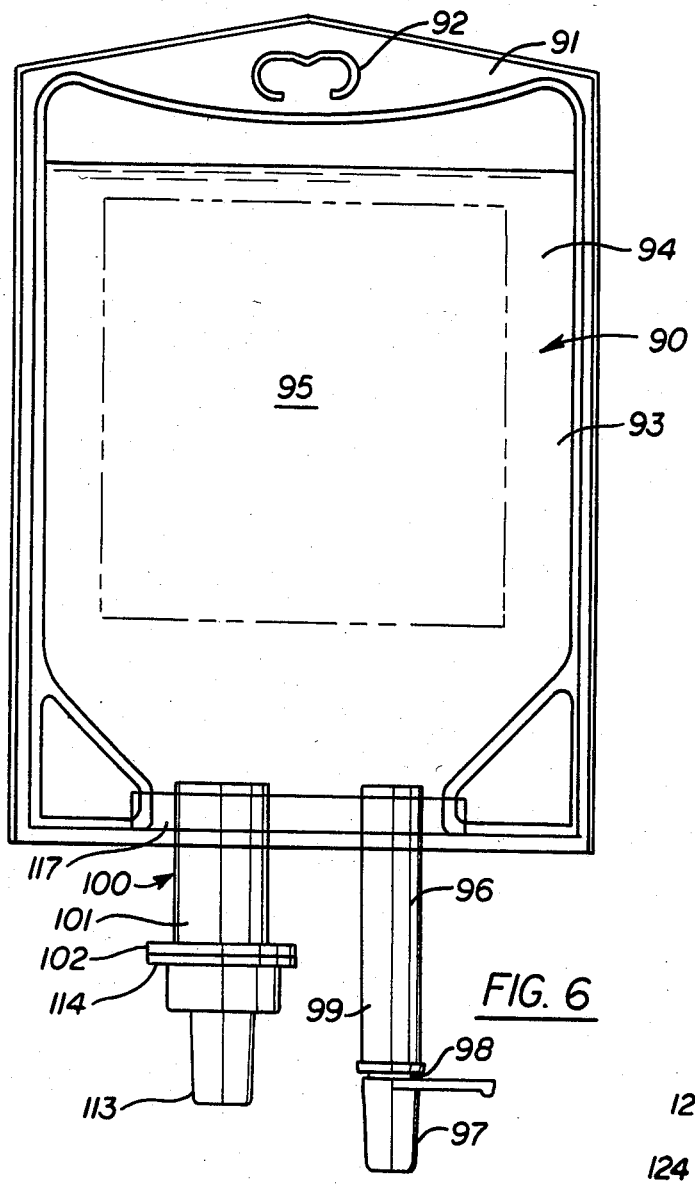
FIG. 6 is a view in front elevation depicting still another embodiment of this invention in conjunction with a flexible intravenous container.
Figure 7:
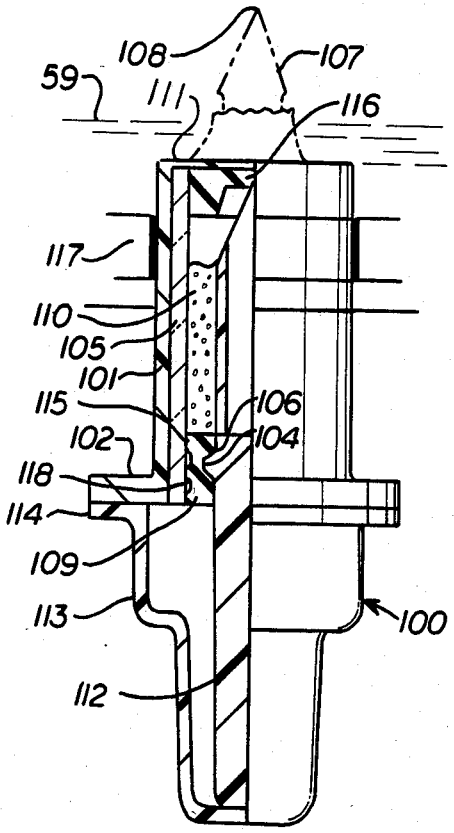
FIG. 7 is an enlarged view in front elevation and in partial vertical section illustrating the activation of the embodiment shown in FIG. 6.

In FIGS. 6 and 7, there is shown a flexible I.V. container generally 94 having the usual hanger section 91 with a hanger detail 92 for receiving a suitable support. A front wall portion 93 will have a suitable label 95 and provide in part a compartment for diluent 59. Unlike the previous embodiments, in this instance the second container generally 100 will not be in direct contact with front wall 93, but will form in effect an additive port or secondary injection site. Second container 100 will include an outer cylindrical wall 101 with flange 102 sealed to flange 114 of collapsible cap 113. Also in fluid communication with the inside of container 90 is an administration port 96 formed from tubular member 99 with a small diameter section 98 for receiving cap 97. As shown in detail in FIG. 7, a powdered medicament material 110 will be sealed inside inner tubular member 105 by means of pierceable seal plug 116 and diaphragm 111 at one end and piston member 109 at the other. A flange 104 on projecting portion 112 and undercut 106 provide the attachment. Sealing rings 115 and 118 afford a sealing relationship with inner tubular member 105.

Figure 8:
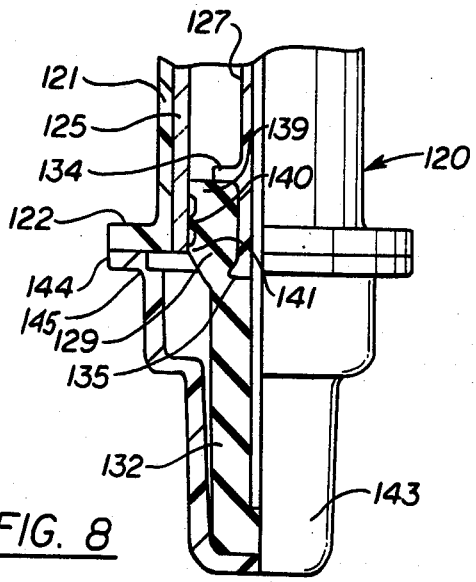
FIG. 8 is a partial view similar to FIG. 7 illustrating yet another embodiment.
Figure 9:
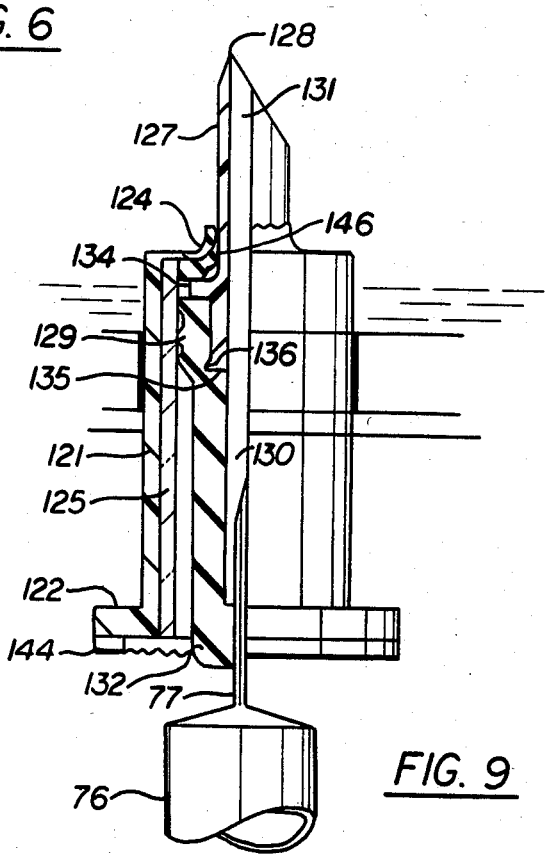
FIG. 9 is a view similar to FIG. 7 showing the FIG. 8 embodiment employed as an injection site.

Referring to second container generally 120 depicted in FIGS. 8 and 9, it will be noted that projecting portion 132 is constructed of a rubber resealable material and has a hollow passage 130. It is innerconnected to piercing pin 127 by means of flange 134 extending from the piercing pin and flange 135 and undercut 136 disposed in the projection and adjacent the piston member 129. A hollow passage 131 is also provided in piercing pin 127 having piercing point 128. Piston member 129 includes sealing rings 139, 140 and 141 for sealing engagement with inner tubular member 125 which is closed at the opposing end by pierceable seal plug 146 and diaphragm 124. As in embodiments 60 and 40, outer cylindrical wall 121 surrounds inner tubular member 125 and has a flange 122 for sealable engagement with flange 144 of flexible cap 143 in a frangible manner through weakened portion 145.

OPERATION

A better understanding of the advantages of container mixing system 10, which will include the first container 12 as well as the second containers 15, 40 or 60, as well as container mixing system 90 with second containers 100 or 120, will be had by a description of their operation.

Referring to FIGS. 1 and 2, secondary container 15 will be filled and fabricated in the manner generally indicated in FIG. 2. A solid or flowable medicament 27 which can be an antibiotic powder, will be placed in inner tubular member 22 when it is seated upon diaphragm 21. The subassembled secondary container 15 will then be sealed to the first container wall 13 by means of sealing elements 33 and 34. The sealing elements are of the R. F. welder or heat fusion type and will hermetically seal flange 19 to wall 13.

The filling of secondary containers 40 and 60 and their assembly and sealing to container wall 13 will be substantially as described in conjunction with secondary container 15.

Concerning container mixing system 90, and the secondary containers 100 and 120, these will be filled with powdered antibiotic material 110 and fabricated in the following manner with reference to secondary container 120. Outer cylindrical wall 121 will be mandrel sealed such as at 117 to bag 94. Glass liner or inner tubular member 125 will be inserted and antibiotic powder such as 110 placed therein. Projecting portion 132, with piston member 129 sealed thereon by means of flanges 135 and 134, will be positioned in tubular member 125 with piston member 129 in sealing contact. Cap 143 will be placed over projecting portion 132 and flange 144 sealed to flange 122.

It will be appreciated that container 12 as well as 94, will be filled with an I.V. diluent material such as water or dextrose. When it is desired to activate container system 10 and secondary container 15, all that is required is to depress cap 30 by placement of the thumb on the end of cap 30 and ultimately projection 29 with the fingers under flange 20. A force exerted in the direction of container 12 will cause piercing point 35 to pierce through diaphragm 21 as well as flexible wall 13. At the same time, piston member 24 will move powdered material 27 in the direction of the bag to deposit it inside container 12. This piercing action and delivery of drug into diluent 59 is best seen in conjunction with FIG. 5. The activation of secondary container 40 will be as previously described for container 12. This embodiment is set forth for the purpose of illustrating a different piston and projection arrangement for moving the powdered material 50 into the diluent container as well as the removal of cap 53, if desired. Referring to secondary container 60, it also will be activated as previously described for containers 15 and 40, the difference here being that cap 73 is removed by frangible flange 74 and projecting portion 72 will be formed from a resealable rubber so that it will act as a secondary injection site. This is illustrated in FIG. 5 and will be attained by means of syringe needle 77 and syringe 76.

Concerning container mixing system 90, this embodiment differs from the previous ones in that the secondary containers 100 and 120 are positioned in the usual manner for an additive port. The activation of the secondary container 100 is the same as that for containers 15 and 40 with the depression of cap 113 and the delivery of powder material 110 as illustrated in FIG. 7. Another distinction is that rather than having the piercing pin piercing through a diaphragm and a wall of a container, as indicated in FIG. 7, the piercing pin 107 with piercing point 108 will pierce through a seal plug 116 as well as diaphragm 111. Concerning secondary container 120, it will operate in a manner similar to container 60 with removal of a cap 143. After the mixing of powder in tubular member 125 with diluent 59, an additional injection of a further medicament can be made by the use of syringe 76 with syringe needle 77 piercing through projecting portion 132. Fluid communication will be made to the inside of the bag through passage 130 in the projection and passage 131 in the hollow piercing member 127. Administration of the mixed contents of container 94 will then be effected in the usual manner through administration port 96. It will be understood that such an administration port 96 will also be used in conjunction with container 12.

The present container mixing systems 10 and 90 have been preferably described for use with a powdered medicament in the secondary containers and a liquid in the first or primary containers. It is obvious that the secondary containers are usable with any fluid material. For example, a liquid could be placed in the secondary containers as well as in the primary one with the diluent. Further, while the present container mixing system has been described for use with fluid materials in the health care field, it will be appreciated that the container mixing system can be applied to other fields. For example, it would have application with any fluid materials where it is necessary to maintain two materials in separate condition until prior to mixing and use, and where one of the materials is sensitive to ambient conditions of the other material. It should be further understood that the term "fluid material" as employed in the specification and claims, is meant to imply any medicament or diluent material which will flow from one compartment to another, whether liquid, solid, or gas.

The preferred material for manufacturing the first containers 12 and 94 is a polyvinylchloride resinous plastic material. However, other resinous plastics such as polypropylene or polyester could be used. The preferred material for composing the outer cylindrical walls such as 17 and 101 is polyvinylchloride. However, other semirigid plastic materials such as polypropylene or polyester could be likewise utilized. The same materials could also be employed for fabricating inner tubular members 22 and 105. The resealable sections of projecting portions such as 72 and 132 is of the standard butyl rubber variety. However, rubber-like plastics such as styrene-butadiene polymers could be substituted.

It will thus be seen that through the present invention there is now provided a manually operated container mixing system which is easily utilized and manufactured. The container system of this invention affords a sterile environment for the fluid materials of any type during storage as well as mixing. Activation of the system is readily accomplished without the use of additional components, with the activation system also serving as a means of adding additional components to the system.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

What is claimed is:

1. A container mixing system for intermixing components in a flexible intravenous solution container comprising:

a first flexible thermoplastic container including wall means with a sterile fluid therein and including at least one administration port;

a second container for sterile fluid material having a pierceable diaphragm at one end and including a tubular sealing member, said second container secured to said first container wall means and including a resilient piston member within and in slidable contact with said tubular sealing member to vary the volume of said second container in response to external force, said resilient piston member including a piercing portion;

so that a force directed on said resilient piston member in the direction of said first container will effect both a piercing of said pierceable diaphragm and said first container wall means by said piercing portion and the removal of said second fluid material from said second container into said first container to provide fluid mixing with said first fluid material.

2. The container mixing system as defined in claim 1 wherein said fluid material in said second container is a powdered material.

3. A container mixing system for intermixing components in a flexible intravenous solution container comprising:

a first flexible thermoplastic container including wall means defining a cavity for a sterile fluid therein and including at least one administration port;

a second container for a sterile fluid material secured through said first container wall means in the manner of an additive port and having a pierceable stopper secured to one end thereof and placed within the said flexible container cavity, said second container including a tubular sealing member;

a resilient piston positioned within and in slidable contact with said tubular sealing member which varies the volume of said container in response to external force, said resilient piston including a piercing pin member;

so that a force directed on said resilient piston and in the direction of said first container will effect both a piercing of said pierceable stopper and the removal of said second fluid material from said second container into said first container to provide fluid mixing with said first fluid material.

4. The container mixing system as defined in claim 3 wherein said fluid material in said second container is a powdered material.

* * * * *